US009441315B2

(12) United States Patent
Ikenaka et al.

(10) Patent No.: US 9,441,315 B2
(45) Date of Patent: Sep. 13, 2016

(54) METHOD FOR KNITTING KNITTED FABRIC AND KNITTED FABRIC

(71) Applicant: SHIMA SEIKI MFG., LTD., Wakayama-shi, Wakayama (JP)

(72) Inventors: Masamitsu Ikenaka, Wakayama (JP); Chiharu Kiyohara, Wakayama (JP)

(73) Assignee: Shima Seiki MFG., LTD., Wakayama (JP)

( * ) Notice: Subject to any disclaimer, the term of this patent is extended or adjusted under 35 U.S.C. 154(b) by 0 days.

(21) Appl. No.: 14/781,335

(22) PCT Filed: Mar. 28, 2014

(86) PCT No.: PCT/JP2014/059170

§ 371 (c)(1),
(2) Date: Sep. 30, 2015

(87) PCT Pub. No.: WO2014/163008

PCT Pub. Date: Oct. 9, 2014

(65) Prior Publication Data

US 2016/0053415 A1 Feb. 25, 2016

(30) Foreign Application Priority Data

Apr. 2, 2013 (JP) ..... 2013-077139

(51) Int. Cl.
*D04B 1/22* (2006.01)
*D04B 1/12* (2006.01)
(Continued)

(52) U.S. Cl.
CPC ..... *D04B 1/22* (2013.01); *D04B 1/123* (2013.01); *D04B 7/12* (2013.01); *D04B 7/30* (2013.01); *D10B 2403/032* (2013.01); *D10B 2501/043* (2013.01)

(58) Field of Classification Search
CPC ..... D04B 7/04; D04B 7/14; D04B 7/12; D04B 7/30; D04B 1/22; D04B 7/18
See application file for complete search history.

(56) References Cited

U.S. PATENT DOCUMENTS 782,480 A * 2/1905 Benndorf ..... D04B 15/80 66/123
2,069,819 A * 2/1937 Diem ..... D04B 1/00 66/190
5,299,435 A * 4/1994 Whalley ..... D04B 1/123 66/190

(Continued)

FOREIGN PATENT DOCUMENTS

JP 10-053942 A 2/1998
JP 11-167824 A 6/1999

(Continued)

OTHER PUBLICATIONS

International Search Report cited in PCT/JP2014/059170 dated Jul. 1, 2014, 2 pages.

*Primary Examiner* — Danny Worrell
(74) *Attorney, Agent, or Firm* — Rothwell, Figg, Ernst & Manbeck, P.C.

(57) ABSTRACT

There is provided a knitted fabric in which a spacing of an open portion can be adjusted as necessary, and a method for knitting the same. An inlay knitting of interweaving a first line (Y1) supplied from a far side line feeder (F1) into a first knitted fabric portion (11) is carried out (process α). An inlay knitting of interweaving a second line (Y2) supplied from a near side line feeder (F2) into a second knitted fabric portion (12) is carried out, and the second line (Y2) is made intersect the first line (Y1) on the open portion (50) side (process β). An inlay knitting of interweaving the first line (Y1) into the first knitted fabric portion (11) is carried out, and a state in which the first line (Y1) is entwined around the second line (Y2) and turned back is obtained (process γ). An inlay knitting of interweaving the second line (Y2) into the second knitted fabric portion (12) is carried out, and a turn-back end of the first line (Y1) and a turn-back end of the second line (Y2) are entwined (process δ).

5 Claims, 2 Drawing Sheets

(51) Int. Cl.
*D04B 7/12* (2006.01)
*D04B 7/30* (2006.01)

(56) References Cited

U.S. PATENT DOCUMENTS 6,116,056 A * 9/2000 Joyce ..... D04B 1/22 66/64
6,151,922 A * 11/2000 Shimasaki ..... D04B 1/02 66/190

FOREIGN PATENT DOCUMENTS

JP 2000-096398 A 4/2000
JP 2001-011759 A 1/2001
JP 2008-261074 A 10/2008

* cited by examiner

METHOD FOR KNITTING KNITTED FABRIC AND KNITTED FABRIC

CROSS REFERENCE TO RELATED APPLICATION

This application is a 35 U.S.C. 371 National Phase Entry Application from PCT/JP2014/059170, filed Mar. 28, 2014, which claims the benefit of Japanese Patent Application No. JP2013-077139 filed on Apr. 2, 2013, the disclosure of which is incorporated herein in its entirety by reference.

TECHNICAL FIELD

The present invention relates to a method for knitting a knitted fabric in which an open portion formed between a first knitted fabric portion and a second knitted fabric portion, which are separated from each other, is connected with a knitting yarn different from the knitting yarn configuring the first knitted fabric portion and the second knitted fabric portion, and a knitted fabric knitted with the method for knitting the knitted fabric.

BACKGROUND ART

For example, Patent Document 1 discloses a method for knitting a knitted fabric in which, when knitting the knitted fabric including a first knitted fabric portion and a second knitted fabric portion which are separated using a flat knitting machine, the open portion formed between the knitted fabric portions are bound with an insertion yarn.

PRIOR ART DOCUMENT

Patent Document

[Patent Document 1] Japanese Laid-Open Patent Publication No. 2008-261074

DISCLOSURE OF THE INVENTION

Problems to be Solved by the Invention

In recent years, various knit products are knitted using a flat knitting machine. The variety of knit products increases if, for example, the spacing of the open portion can be adjusted as necessary in a knitted fabric including the open portion. However, the method for knitting the knitted fabric described in Patent Document 1 is a technique for temporarily tacking the open portion, and the spacing of the open portion thus cannot be freely adjusted as necessary in the knitted fabric obtained with this method for knitting the knitted fabric. In the method for knitting of Patent Document 1, the binding of the stitches of the first knitted fabric portion and the stitches of the second knitted fabric portion in the vicinity of the open portion with the insertion yarn is carried out continuously in a wale direction of the knitted fabric, and hence the insertion yarn is arranged so as to sew the open portion in the wale direction of the knitted fabric.

The present invention has been made in light of the above circumstances, and an object of the present invention is to provide a method for knitting a knitted fabric of knitting a knitted fabric capable of adjusting the spacing of the open portion as necessary. It is another object of the present invention to provide a knitted fabric obtained with the method for knitting the knitted fabric of the present invention.

Means for Solving the Problems

An aspect of the present invention relates to a method for knitting a knitted fabric of, when knitting a first knitted fabric portion with a first needle bed and knitting a second knitted fabric portion with a second needle bed using a flat knitting machine including the first needle bed and the second needle bed disposed opposite to each other, connecting an open portion of the knitted fabric portions formed at an end in a knitting width direction of the first knitted fabric portion and the second knitted fabric portion with a line different from a knitting yarn configuring the first knitted fabric portion and the second knitted fabric portion. The method for knitting the knitted fabric of the invention carries out the following processes α to δ assuming a line feeder arranged on the first needle bed side, of a plurality of line feeders arranged in the flat knitting machine to supply the line, is a near side line feeder and a line feeder arranged on the second needle bed side with respect to the near side line feeder is a far side line feeder.

[Process α] Moving the far side line feeder toward the open portion and carrying out an inlay knitting of interweaving a first line supplied from the far side line feeder into the first knitted fabric portion.

[Process β] Moving the near side line feeder toward the open portion and carrying out an inlay knitting of interweaving a second line supplied from the near side line feeder into the second knitted fabric portion, and making the second line intersect the first line on the open portion side.

[Process γ] Moving the far side line feeder toward the side away from the open portion and carrying out an inlay knitting of interweaving the first line into the first knitted fabric portion, and obtaining a state in which the first line is entwined around the second line and turned back.

[Process δ] Moving the near side line feeder toward the side away from the open portion and carrying out an inlay knitting of interweaving the second line into the second knitted fabric portion, and entwining a turn-back end of the first line with a turn-back end of the second line.

The "line" may be any elongated string of materials, and is representatively a knitting yarn, but is not limited to the knitting yarn. The "line feeder" for supplying the knitting yarn as the "line" is referred to as a "yarn feeder".

The inlay knitting is a known knitting of interweaving the line so as to thread between the stitches. For example, an inlay knitting of transferring a part of a stitch row held on the first needle bed to the opposing second needle bed, supplying a line between the needle beds, and then returning the stitches transferred to the second needle bed to the first needle bed is known. Alternatively, an inlay knitting of carrying out split knitting on at least a part of the stitch row held on the first needle bed, supplying a line between the first needle bed and the second needle bed, and then transferring the stitches of the second needle bed to the first needle bed is known. In addition, an inlay knitting of knitting the stitch row with the first needle bed and carrying out tuck with the second needle bed, supplying a line between the needle beds, and then transferring the tuck stitches of the second needle bed to the first needle bed is also known.

According to one aspect of the method for knitting the knitted fabric of the present invention, process α to process δ are repeated multiple times.

According to another aspect of the method for knitting the knitted fabric of the present invention, a knitting yarn configuring the first knitted fabric portion and the second knitted fabric portion contains a thermal adhesive yarn, and the first line and the second line do not contain a thermal adhesive yarn.

An aspect of the present invention relates to a knitted fabric knitted using a flat knitting machine including a first needle bed and a second needle bed disposed opposite to each other, the knitted fabric including a first knitted fabric portion and a second knitted fabric portion separated with an open portion in between. The knitted fabric of the invention includes a first line interwoven in the first knitted fabric portion through an inlay knitting with a side of the open portion as a turn-back end; and a second line interwoven in the second knitted fabric portion through an inlay knitting with a side of the open portion as a turn-back end. In the knitted fabric of the invention, the turn-back end of the first line and the turn-back end of the second line arranged in the knitted fabric are entwined at the position of the open portion.

According to one aspect of the knitted fabric of the present invention, the first knitted fabric portion is one side surface of a shoe upper, and the second knitted fabric portion is the other side surface of the shoe upper.

Effects of the Invention

According to the method for knitting the knitted fabric of the present invention, the knitted fabric of the present invention in which the first knitted fabric portion and the second knitted fabric portion separated with the open portion in between are connected by the first line and the second line can be knitted. The first line and the second line are interwoven into the first knitted fabric portion and the second knitted fabric portion, respectively, by the inlay knitting. The line interwoven in the knitted fabric portion by the inlay knitting is not fixed to the stitches of the knitted fabric portion and is merely sandwiched between the stitches configuring the knitted fabric portion, and thus the line can easily move with respect to the knitted fabric portion (see loop diagram of lowermost stage of FIG. 1, to be described later). Thus, the spacing of the open portion can be reduced by pulling both lines toward the side away from the open portion, for example. Furthermore, the spacing of the open portion can be increased by pulling the knitted fabric portion to the right and left, for example.

According to the method for knitting the knitted fabric of the present invention of repeating the process $\alpha$ to the process $\delta$, the first knitted fabric portion and the second knitted fabric portion having the open portion in between can be strongly connected. Furthermore, the spacing of the open portion formed between the knitted fabric portions can be easily and finely adjusted.

The first knitted fabric portion and the second knitted fabric portion may contain thermal adhesive yarn, so that if the thermal process is performed on the knitted fabric of the present invention, the knitted fabric is less likely to lose shape. Moreover, the first line and the second line may not contain the thermal adhesive yarn, so that the lines can be suppressed from being fixed to the knitted fabric portions. For details, reference is to be made to the section "Others" in the third embodiment.

MODE FOR CARRYING OUT THE INVENTION

First Embodiment

In a first embodiment, one example of a knitting procedure of a method for knitting a knitted fabric of the present invention using a two-bed flat knitting machine including at least a pair of a front and a back need bed and in which stitches can be transferred between the front and back needle beds will be described based on the knitting process diagram of FIG. 1. The flat knitting machine to be used is not limited to the two-bed flat knitting machine and may be a four-bed flat knitting machine, for example.

Figure 1:
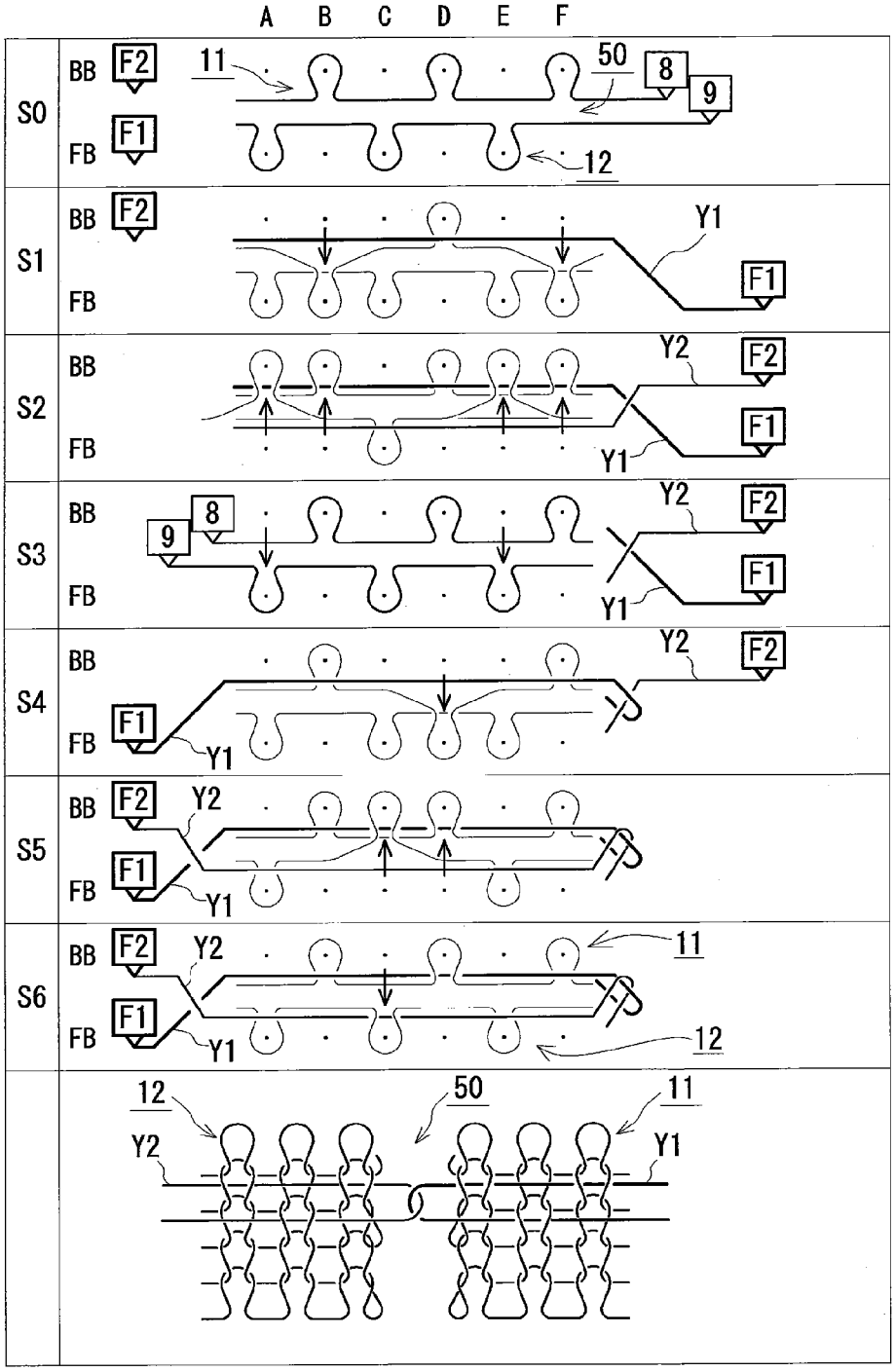
FIG. 1 is a knitting process diagram according to a method for knitting a knitted fabric according to the present invention shown in a first embodiment.

"S+number" in the left column in the knitting process diagram of FIG. 1 indicates the number of knitting process, and a held state of the stitches in each knitting process is shown in the right column. A black dot of the right column indicates a knitting needle of a front needle bed FB and a back needle bed BB, and an arrow indicates a direction of transfer of the stitches. Upper case alphabets A to F in the right column indicate the positions of the knitting needles.

In S0, a state in which a knitted fabric portion 11 is held on the knitting needles B, D, F of the back needle bed BB, and a knitted fabric portion 12 is held on the knitting needles A, C, E of the front needle bed FB is shown. In the present embodiment, a description will be made with the back needle bed BB as a first needle bed, the front needle bed FB as a second needle bed, the knitted fabric portion 11 as a first knitted fabric portion, and the knitted fabric portion 12 as a second knitted fabric portion. A yarn feeder 8 for feeding a base knitting yarn configuring the first knitted fabric portion 11 is on the first needle bed BB side, and a yarn feeder 9 for feeding a base knitting yarn configuring the second knitted fabric portion 12 is on the second needle bed FB side with respect to the first needle bed BB, and thus the first knitted fabric portion 11 and the second knitted fabric portion 12 are not connected on the right side in the plane of drawing. That is, an open portion 50 separating the first knitted fabric portion 11 and the second knitted fabric portion 12 is formed at an end in a knitting width direction of the knitted fabric portions 11, 12. The front needle bed FB may be defined as a first needle bed and the back needle bed BB may be defined as a second needle bed, in which case, the definition of "first" and "second", and the like may be appropriately changed.

Although not specifically shown in FIG. 1, the first knitted fabric portion 11 and the second knitted fabric portion 12 may be connected or may not be connected on the left side in the plane of drawing. When knitting the knitted fabric in which both knitted fabric portions 11, 12 are connected on the left side, for example, the knitted fabric portions 11, 12 may be knitted by C-shaped knitting using either the yarn feeder 8 or the yarn feeder 9. If the knitted fabric portions 11, 12 are not connected on the left side, that is, if the open portion is also formed on the left side, the method for knitting the knitted fabric of the present invention may be applied also to the open portion on the left side (specifically described in second embodiment).

The method for knitting the knitted fabric of the present invention shown in S1 to S6 is performed using yarn feeders (line feeders) F1, F2 different from the yarn feeders 8, 9 from the state shown in S0. The yarn feeder F2 is on a near side when seen from the first needle bed BB, and is assumed as a near side yarn feeder (near side line feeder) in the present embodiment. The yarn feeder F1 is on the second needle bed FB side with respect to the near side yarn feeder F2 when seen from the first needle bed BB, and thus is assumed as a far side yarn feeder (far side line feeder) in the present embodiment.

In S1, the following [a] and [b] are carried out in order.

[a] Transfer the stitches held on the knitting needles B, F of the first needle bed BB, which are part of the first knitted fabric portion 11, to the knitting needles B, F of the second needle bed FB.

[b] Move the far side yarn feeder F1 toward the open portion 50 side.

According to [a], a plurality of stitches configuring the first knitted fabric portion 11 are held separately on the first needle bed BB and the second needle bed FB. This is a preliminary preparation for an inlay knitting carried out with respect to the first knitted fabric portion 11.

According to [b], a line Y1 (first line in the present embodiment) fed from the far side yarn feeder F1 is arranged between the first needle bed BB and the second needle bed FB.

In S2, the following [c], [d], [e] are carried out in order.

[c] Return the stitches of the first knitted fabric portion 11 transferred to the knitting needles B, F of the second needle bed FB in S1 to the knitting needles B, F of the first needle bed BB.

[d] Transfer the stitches held on the knitting needles A, E of the second needle bed FB, which are part of the second knitted fabric portion 12, to the knitting needles A, E of the first needle bed BB.

[e] Move the near side yarn feeder F2 toward the open portion 50.

According to [a], [b] of S1 and [c] of S2, the inlay knitting of interweaving the first line Y1 into the first knitted fabric portion 11 is carried out (corresponds to process α of the present invention).

According to [d], a plurality of stitches configuring the second knitted fabric portion 12 is held separately on the second needle bed FB and the first needle bed BB. This is the preliminary preparation for the inlay knitting carried out with respect to the second knitted fabric portion 12.

According to [e], a line Y2 (second line in the present embodiment) fed from the near side yarn feeder F2 is arranged between the second needle bed FB and the first needle bed BB. In this case, the second line Y2 intersects the first line Y1 on the side of the open portion 50 due to the position relationship of the near side yarn feeder F2 and the far side yarn feeder F1 in the opposing direction of the needle beds.

In S3, the following [f], [g] are carried out.

[f] Return the stitches of the second knitted fabric portion 12 transferred to the knitting needles A, E of the first needle bed BB in S2 to the knitting needles A, E of the second needle bed FB.

[g] Knit the knitted fabric portions 11, 12 for one row using the yarn feeders 8, 9.

According to [d], [e] of S2 and [f] of S3, the inlay knitting of interweaving the second line Y2 into the second knitted fabric portion 12 is carried out (corresponds to process β of the present invention).

According to [g], the stitch row of the knitted fabric portions 11, 12, into which the lines Y1, Y2 are interwoven, is knitted down by one row. The knitted fabric portions 11, 12 may be knitted for greater than or equal to two rows, or [g] may be omitted.

In S4, the following [h] and [i] are carried out.

[h] Transfer the stitch held on the knitting needle D of the first needle bed BB, which is part of the first knitted fabric portion 11, to the knitting needle D of the second needle bed FB.

[i] Move far side yarn feeder F1 toward the side away from the open portion 50.

Here, [h] is the preliminary preparation for the inlay knitting carried out with respect to the first knitted fabric portion 11, similar to [a] of S1. In [h], the stitch held on the knitting needle different from [a] is transferred, but the stitches held on the knitting needles same as [a] may be transferred.

According to [i], the first line Y1 fed from the far side yarn feeder F1 is arranged between the first needle bed BB and the second needle bed FB.

In S5, the following [j], [k], [m] are carried out in order.

[j] Return the stitch of the first knitted fabric portion 11 transferred to the knitting needle D of the second needle bed FB in S4 to the knitting needle D of the first needle bed BB.

[k] Transfer the stitch held on the knitting needle C of the second needle bed FB, which is part of the second knitted fabric portion 12, to the knitting needle C of the first needle bed BB.

[m] Move the near side yarn feeder F2 toward the side away from the open portion 50. In this case, the first line Y1 is entwined around the second line Y2 and turned back.

According to [h], [i] of S4 and [j] of S5, the inlay knitting of interweaving the first line Y1 into the first knitted fabric portion 11 is carried out (corresponds to process γ of the present invention).

Here, [k] is the preliminary preparation for the inlay knitting carried out with respect to the second knitted fabric portion 12, similar to [d] of S2. In [k], the stitches of the knitting needles A, E of the second needle bed FB may be transferred.

According to [m], the second line Y2 fed from the near side yarn feeder F2 is arranged between the second needle bed FB and the first needle bed BB.

In S6, [n] is carried out to return the stitch of the second knitted fabric portion 12 transferred to the kitting needle C of the first needle bed BB in S5 to the knitting needle C of the second needle bed FB.

According to [k] and [m] of S5 and [n] of S6, the inlay knitting of interweaving the second line Y2 into the second knitted fabric portion 12 is carried out (corresponds to process δ of the present invention). As a result of the inlay knitting, the turn-back end of the first line Y1 and the turn-back end of the second line Y2 are entwined at the position of the open portion 50.

When the knitted fabric obtained through S1 to S6 described above is unfolded, a loop diagram shown at the lowermost stage of FIG. 1 is obtained. The knitted fabric includes the first knitted fabric portion 11 and the second knitted fabric portion 12 separated with the open portion 50 in between, where the first line Y1 and the second line Y2 are interwoven through the inlay knitting into the first knitted fabric portion 11 and the second knitted fabric portion 12, respectively. A connecting portion where the turn-back end of the first line Y1 and the turn-back end of the second line Y2 are entwined to an X-shape is formed at the position of the open portion 50, and both knitted fabric portions 11, 12 are connected so that the spacing of the open portion 50 does not excessively open.

The lines Y1, Y2 are not fixed to the stitches of the knitted fabric portions 11, 12 and are merely sandwiched between the stitches configuring the knitted fabric portions 11, 12, and hence the lines Y1, Y2 can easily move with respect to the knitted fabric portions 11, 12. Thus, for example, when one end of the line Y1, Y2 is pulled toward the side away from the open portion 50, the spacing of the open portion 50 can be reduced. Furthermore, when the knitted fabric portions 11, 12 are pulled to the right and left, for example, the spacing of the open portion 50 can be increased.

Furthermore, the lines Y1, Y2 also play a role of suppressing the stretching in the knitting width direction of the knitted fabric portions 11, 12. This is because the lines Y1, Y2 are arranged along the knitting width direction of the knitted fabric portions 11, 12, and the stress that acts when the knitted fabric portions 11, 12 are pulled in the knitting width direction is shared by the lines Y1, Y2. In particular, if the lines Y1, Y2 are the knitting yarns of high strength that are less likely to stretch, the suppressing effect of stretching can be enhanced. The lines Y1, Y2 are merely sandwiched between the stitches of the knitted fabric portions 11, 12, and hence merely need to be an elongated string of members, and the material/form thereof is not particularly limited. For example, the material may be wool or silk, cotton, acryl, rayon, nylon, polyester, aramid, polypropylene, carbon fiber, metal (including alloy), and the like. The form may be a knitting yarn, a string, a tape, a chain, and the like. For example, a metallic tape can be used for the lines Y1, Y2.

Second Embodiment

The connecting portion at the position of the open portion 50 on the right side in the plane of drawing may be repeatedly formed by repeating the knitting similar to S1 to S6 described in the first embodiment. It should be noted that when further forming the connecting portion at the position of the open portion 50 on the right side, the first line Y1 and the second line Y2 intersect on the left side (see S6). To prevent the lines Y1, Y2 from entwining, the yarn feeder F2 needs to be moved first. That is, the knitting similar to S1 to S6 is carried out assuming that the front needle bed FB is the first needle bed, the back needle bed BB is the second needle bed, the knitted fabric portion 12 is the first knitted fabric portion, the knitted fabric portion 11 is the second knitted fabric portion, the yarn feeder F1 is the near side yarn feeder and the yarn feeder F2 is the far side yarn feeder.

In the case when the open portion is formed also on the left side in the plane of drawing and if the connecting portion where the lines Y1, Y2 are entwined is to be formed at the open portion on the left side, the yarn feeder F1 should be moved first. In this case, the process γ and process δ with respect to the open portion 50 on the right side described with reference to S4 to S6 of FIG. 1 are assumed to be process α and process β with respect to the open portion on the left side, and the process γ and the process δ with respect to the open portion on the left side are carried out following S6. The process γ and the process δ with respect to the open portion on the left side are respectively the process α and the process β with respect to the open portion on the right side.

As described above, the connecting portion where the lines Y1, Y2 are entwined can be successively formed only at one end side in the knitting width direction, or the connecting portion may be successively formed at both ends in the knitting width direction.

Third Embodiment

In a third embodiment, an example in which the method for knitting the knitted fabric of the present invention is applied to the knitting of the shoe upper will be described based on FIG. 2.

<<Overall Configuration>>

Figure 2:
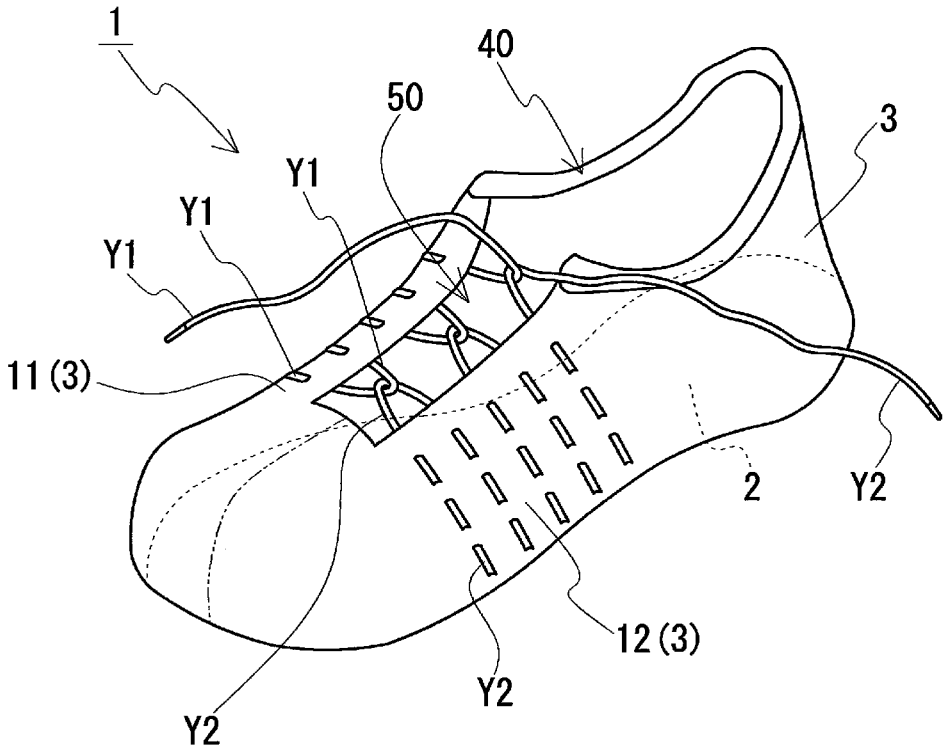
FIG. 2 is a schematic configuration diagram of a shoe upper including a portion knitted by applying the method for knitting the knitted fabric of the present invention.

The shoe upper 1 (knitted fabric) of the present embodiment shown in FIG. 2 includes an instep cover section 3 that covers a portion on an instep side of a foot of a wearer, and a sole cover section 2 that covers a portion of a sole of the wearer. A slit-shaped open portion 50 extending from an insert opening 40 toward the toe is formed in the instep cover section 3, so that the foot can be easily inserted from the insert opening 40. A shoelace is normally arranged in the open portion 50, so that the spacing of the open portion 50 can be adjusted. In the shoe upper 1 in the present embodiment, on the other hand, the method for knitting the knitted fabric of the present invention is applied to the position in the vicinity of the slit-shaped open portion 50 to interweave the lines Y1, Y2 into the shoe upper 1, and such lines Y1, Y2 are used as a shoelace.

<<Procedure for Producing Shoe Upper>>

The shoe upper 1 can be produced by knitting the right side portion of the instep cover section 3 and the sole cover section 2 with one needle bed, and the left side portion of the instep cover section 3 and the sole cover section 2 with the other needle bed. For example, the knitting is started from the toe side of the shoe upper 1, and the shoe upper 1 is knitted to the position of a cut end of the slit-shaped open portion 50. For example, the right side portion and the left side portion may be knitted through the C-shaped knitting, and the right side portion and the left side portion may be connected at the position indicated with a chain double-dashed line in the figure. Alternatively, the right side portion and the left side portion may be successively knitted through tubular knitting.

Assuming that the right side portion of the shoe upper 1 is the first knitted fabric portion 11 (or second knitted fabric portion 12) and the left side portion is the second knitted fabric portion 12 (or first kitted fabric portion 11), the first line Y1 and the second line Y2 are interwoven into the first knitted fabric portion 11 and the second knitted fabric portion 12, respectively, according to the knitting process diagram of FIG. 1. For example, the first knitted fabric portion 11 and the second knitted fabric portion 12 including the slit-shaped open portion 50 may be knitted through the C-shaped knitting using the same knitting yarn, and the inlay knitting may be carried out between the first knitted fabric portion 11 and the second knitted fabric portion 12. According to such inlay knitting, the lines Y1, Y2 are interwoven into the instep cover section 3 while being turned back at the position of the open portion 50 of the instep cover section 3 and the position in the vicinity of the boundary of the instep cover section 3 and the sole cover section 2, respectively. The turn-back ends of the lines Y1, Y2 arranged at the position of the open portion 50 are entwined, and the open portion 50 is connected with the lines Y1, Y2. The lines Y1, Y2 may be extended to the sole cover section 2, and the turn-back ends of the lines Y1, Y2 extended to the sole cover section 2 may be entwined at the position of the sole cover section 2. In the latter case, especially, the stretching in the peripheral direction of the sections 2, 3 can be suppressed over the entire periphery regardless of the material of the instep cover section 3 and the sole cover section 2, and the fitting property of the shoe upper 1 can be enhanced.

Lastly, the knitting of the shoe upper 1 is carried out toward the heel of the shoe upper 1 to complete the shoe upper 1. The shoe upper 1 may be set up from the heel side, and the knitting thereof may be terminated on the toe side.

<<Effect of Shoe Upper>>

In the shoe upper 1 knitted according to the knitting procedure described above, the first line Y1 and the second line Y2 serve as a shoelace for finely adjusting the spacing of the open portion 50. The lines Y1, Y2 suppress the stretching in the knitting width direction of the knitted fabric portions 11, 12 at the portions where the lines Y1, Y2 are interwoven. If the stretching of the relevant portions can be suppressed, the shoe upper 1 is less likely to lose shape and the fitting property of the shoe upper 1 can be enhanced. Furthermore, since apart of the lines Y1, Y2 is exposed on the surface of the shoe upper 1, the lines Y1, Y2 constitute a part of the design of the shoe upper 1.

<<Others>>

The base knitting yarn configuring the knitted fabric portions 11, 12 of the shoe upper 1 preferably contains a thermal adhesive yarn. Thus the shoe upper 1 can be three-dimensionally molded by fitting the shoe upper 1 to a last (foot form) and performing thermal processing on it, after the knitting of the shoe upper 1 is completed. If the base knitting yarn contains the thermal adhesive yarn, the lines Y1, Y2 preferably do not contain a thermal adhesive yarn. This is because, if the lines Y1, Y2 contain the thermal adhesive yarn, it may strongly bond with the thermal adhesive yarn of the base knitting yarn and the lines Y1, Y2 may be fixed to the knitted fabric portions 11, 12. If the lines Y1, Y2 do not contain the thermal adhesive yarn, on the other hand, the lines Y1, Y2 are less likely to be fixed to the knitted fabric portions 11, 12 even if the knitted fabric portions 11, 12 contain the thermal adhesive yarn. As a result, the performance of adjusting the spacing of the open portion 50 by the lines Y1, Y2 can be ensured.

Fourth Embodiment

The method for knitting the knitted fabric of the present invention can be applied to various knit products other than the shoe upper 1 shown in the third embodiment. For example, the open portion may be formed at the position of the cuff or the neck hole of a knit wear, and such open portion may be connected through the method for knitting the knitted fabric of the present invention to enhance the designability of the knit wear.

DESCRIPTION OF REFERENCE NUMERALS

11 knitted fabric portion (first knitted fabric portion)
12 knitted fabric portion (second knitted fabric portion)
FB front needle bed (second needle bed)
BB back needle bed (first needle bed)
F1 yarn feeder (far side line feeder)
F2 yarn feeder (near side line feeder)
8, 9 yarn feeder
Y1 line (first line)
Y2 line (second line)
50 open portion
1 shoe upper
2 sole cover section
3 instep cover section
40 insert opening

The invention claimed is:

1. A method for knitting a knitted fabric of, when knitting a first knitted fabric portion with a first needle bed and knitting a second knitted fabric portion with a second needle bed using a flat knitting machine including the first needle bed and the second needle bed disposed opposite to each other, connecting an open portion of the knitted fabric portions formed at an end in a knitting width direction of the first knitted fabric portion and the second knitted fabric portion with a line different from a knitting yarn configuring the first knitted fabric portion and the second knitted fabric portion, with a line feeder arranged on the first needle bed side, of a plurality of line feeders arranged in the flat knitting machine to supply the line, being a near side line feeder and a line feeder arranged on the second needle bed side with respect to the near side line feeder being a far side line feeder, the method comprising:

process α of moving the far side line feeder toward the open portion and carrying out an inlay knitting of interweaving a first line supplied from the far side line feeder into the first knitted fabric portion;

process β of moving the near side line feeder toward the open portion and carrying out an inlay knitting of interweaving a second line supplied from the near side line feeder into the second knitted fabric portion, and making the second line intersect the first line on the open portion;

process γ of moving the far side line feeder toward the side away from the open portion and carrying out an inlay knitting of interweaving the first line into the first knitted fabric portion, and obtaining a state in which the first line is entwined around the second line and turned back; and process δ of moving the near side line feeder toward the side away from the open portion and carrying out an inlay knitting of interweaving the second line into the second knitted fabric portion, and entwining a turn-back end of the first line and a turn-back end of the second line, wherein "line" refers to any elongated string of materials.

2. The method for knitting the knitted fabric according to claim 1, wherein process α to process δ are repeated multiple times.

3. The method for knitting the knitted fabric according to claim 2, wherein a knitting yarn configuring the first knitted fabric portion and the second knitted fabric portion contains a thermal adhesive yarn, and the first line and the second line do not contain a thermal adhesive yarn.

4. A knitted fabric knitted using a flat knitting machine including a first needle bed and a second needle bed disposed opposite to each other, the knitted fabric including a first knitted fabric portion and a second knitted fabric portion separated with an open portion in between; the knitted fabric comprising:

a first line interwoven in the first knitted fabric portion through an inlay knitting with a side of the open portion as a turn-back end; and a second line interwoven in the second knitted fabric portion through an inlay knitting with a side of the open portion as a turn-back end; wherein the turn-back end of the first line and the turn-back end of the second line are entwined at the position of the open portion, wherein "line" refers to any elongated string of materials.

5. The knitted fabric according to claim 4, wherein the first knitted fabric portion is one side surface of a shoe upper, and the second knitted fabric portion is the other side surface of the shoe upper.

* * * * *